US006364381B1

(12) United States Patent
Schmidt et al.

(10) Patent No.: US 6,364,381 B1
(45) Date of Patent: Apr. 2, 2002

(54) QUEUE CLIP FOR CONTROL GATES

(75) Inventors: James R. Schmidt; Alan M. Levy; George Konovalov; David D. Danon; Scot M. Burklin, all of Universal City, CA (US)

(73) Assignee: Universal City Studios, Inc., Universal City, CA (US)

( * ) Notice: Subject to any disclaimer, the term of this patent is extended or adjusted under 35 U.S.C. 154(b) by 0 days.

(21) Appl. No.: 09/333,639

(22) Filed: Jun. 15, 1999

(51) Int. Cl.[7] ..... E05C 17/36
(52) U.S. Cl. ..... 292/264; 248/304
(58) Field of Search ..... 292/264, DIG. 16; 70/93; 24/116 R; 119/772, 778, 779; 248/288.11, 290.1, 289.11, 292.14, 294.1, 303–306; 403/230, 263

(56) References Cited

U.S. PATENT DOCUMENTS

| | | | | | |
|---|---|---|---|---|---|
| 252,940 | A | * | 1/1882 | Hayden | 248/304 |
| 309,621 | A | * | 12/1884 | Herrick | 248/304 |
| 520,634 | A | * | 5/1894 | Cochrane | 248/288.11 |
| 546,102 | A | * | 9/1895 | Jenkins | 292/264 |
| 890,518 | A | | 6/1908 | Kleidmann | |
| 1,422,128 | A | * | 7/1922 | Roger | 248/306 |
| 1,540,854 | A | | 6/1925 | Mack | |
| 2,321,272 | A | * | 6/1943 | Becwar | 343/882 |
| 3,239,280 | A | * | 3/1966 | Fielder | 403/230 |
| 3,353,570 | A | * | 11/1967 | Sweat | 139/88 |
| 3,847,336 | A | * | 11/1974 | Morris | 248/294 |
| 3,900,180 | A | * | 8/1975 | McPhee | 248/288 |
| 3,957,241 | A | * | 5/1976 | Morris | 248/288 |
| 4,231,327 | A | | 11/1980 | Mader | |
| 4,254,975 | A | | 3/1981 | Miller | |
| 4,422,678 | A | | 12/1983 | Tuckett et al. | |
| 4,447,081 | A | | 5/1984 | Stottlemyre | |
| 4,646,807 | A | | 3/1987 | Doublet | |
| 5,020,840 | A | | 6/1991 | Winter | |
| 5,022,694 | A | * | 6/1991 | Thomison | 294/82.2 |
| 5,105,521 | A | * | 4/1992 | Dowd | 29/453 |
| 5,161,784 | A | | 11/1992 | Sader | |
| 5,210,898 | A | * | 5/1993 | Carey | 15/176.2 |
| 5,329,883 | A | * | 7/1994 | White | 119/779 |
| 5,402,988 | A | | 4/1995 | Eisele | |

* cited by examiner

*Primary Examiner*—Gary Estremsky
(74) *Attorney, Agent, or Firm*—Lyon & Lyon LLP

(57) ABSTRACT

A queue clip for mounting to a control gate includes a holder having a nose extending from one wall of the holder. A tongue is cantilevered off the nose and may be angled to either side of the nose. The tongue preferably supports a chain linking one crowd control gate to another. The tongue is inclined in an upward fashion to support downward chain forces. The tongue may also be angled to a particular side of the nose to allow the chain to be slid off the tongue such that a person may pass between the previously linked control gates.

30 Claims, 5 Drawing Sheets

42
44
34
46
Fo 44
24
54
46
Fo 34
46
12
14
16

QUEUE CLIP FOR CONTROL GATES

FIELD OF THE INVENTION

The field of the invention is queue clips and control gates of the type used to guide lines of people e.g., at parades and amusement parks.

BACKGROUND OF THE INVENTION

Control gates are commonly used, for example, at a parade, for separating the spectators from the participants, or at amusement parks, to help to guide people waiting in line.

In use, these gates may be connected together. However, they are more typically spaced apart from one another, to allow for an emergency situation where a person might need to move rapidly outwardly or away from the direction of the queue. To discourage a person from freely passing between spaced-apart gates, a chain or the like is typically used to link one end of a gate to another. For example, a yellow, lightweight plastic chain is often used at amusement parks.

Local ordinances may require the chain and queue clip for linking one control gate to another to be a "break-away" for emergencies. To comply with such a local ordinance, the chain may be modified by partially sawing through one of the links of a chain, such as the light-weight plastic chain typically employed by amusement parks, to weaken the chain enough so that it can easily break-away. Alternatively, a chain with a low breaking strength may be used. However, persons waiting in line may occasionally sit on the chain, inadvertently breaking the chain.

Accordingly, it is an object of the invention to provide an improved queue clip, or latch and chain device particularly adapted for use with control gates, that can hold the weight of persons sitting on the chain, and yet be versatile enough to break-away or release in an emergency. Other objects and advantages will appear hereinafter.

SUMMARY OF THE INVENTION

To these ends, in a first aspect of the invention, the device includes a holder having a rod angled to the holder. Although the device may be used as a latch or the like for numerous different types of gates, the device is particularly adapted for use with control gates. Accordingly, the holder of the device is preferably mounted to a control gate that is linked to another control gate via a chain. A tongue or rod of the device supports one end of the chain, which may be a hardened steel chain or the like. The rod is preferably angled to the holder for supporting downward chain forces. Hence, the latch and chain will not release if a person sits on the chain.

The rod is also angled to the holder for slidably releasing the chain in one direction or to one side of the holder, once sufficient force is applied against the chain to make it travel up and over the tip of the rod. Accordingly, the device allows a member standing in line to briskly walk or run against one side of the chain, forcing the chain to slide off of the tongue, such that the person can freely pass between the previously linked control gates.

In a second aspect of the invention, the holder may include a pair of bores for respectively receiving the tongue or rod of the queue clip. The bores are preferably threaded. One bore is configured to open toward the front wall of the holder, whereas the second bore is configured to open toward the rear wall of the holder. Advantageously, this second preferred embodiment allows the tongue to be retained in either bore. In this manner, the user can set the queue clip and gates at pre-designated locations regardless of whether the side of the crowd control gate having the queue clip mounted thereto is facing inward to where the queue will be or outward to where the queue will be. Accordingly, queue clip need not be remounted if the direction of release of the chain is not as desired, rather, the user need only screw the tongue into the other bore.

In a third aspect of the invention, the holder may include a channel adapted to receive the tongue such that the tongue is translatable within the channel. Advantageously, this embodiment allows quick release of the chain from the tongue support without concern as to which direction a person in line may have to move in to get by the gates.

BRIEF DESCRIPTION OF THE DRAWINGS

Other objects and features of the invention will become apparent from the following detailed description taken in connection with the accompanying drawings. It should be understood, however, that the drawings are intended for the purpose of illustration only, and are not to be taken as a definition of the limits of the invention.

In the drawings, wherein the same reference number denotes the same element throughout all of the views.

DETAILED DESCRIPTION OF THE DRAWINGS

Figure 1:
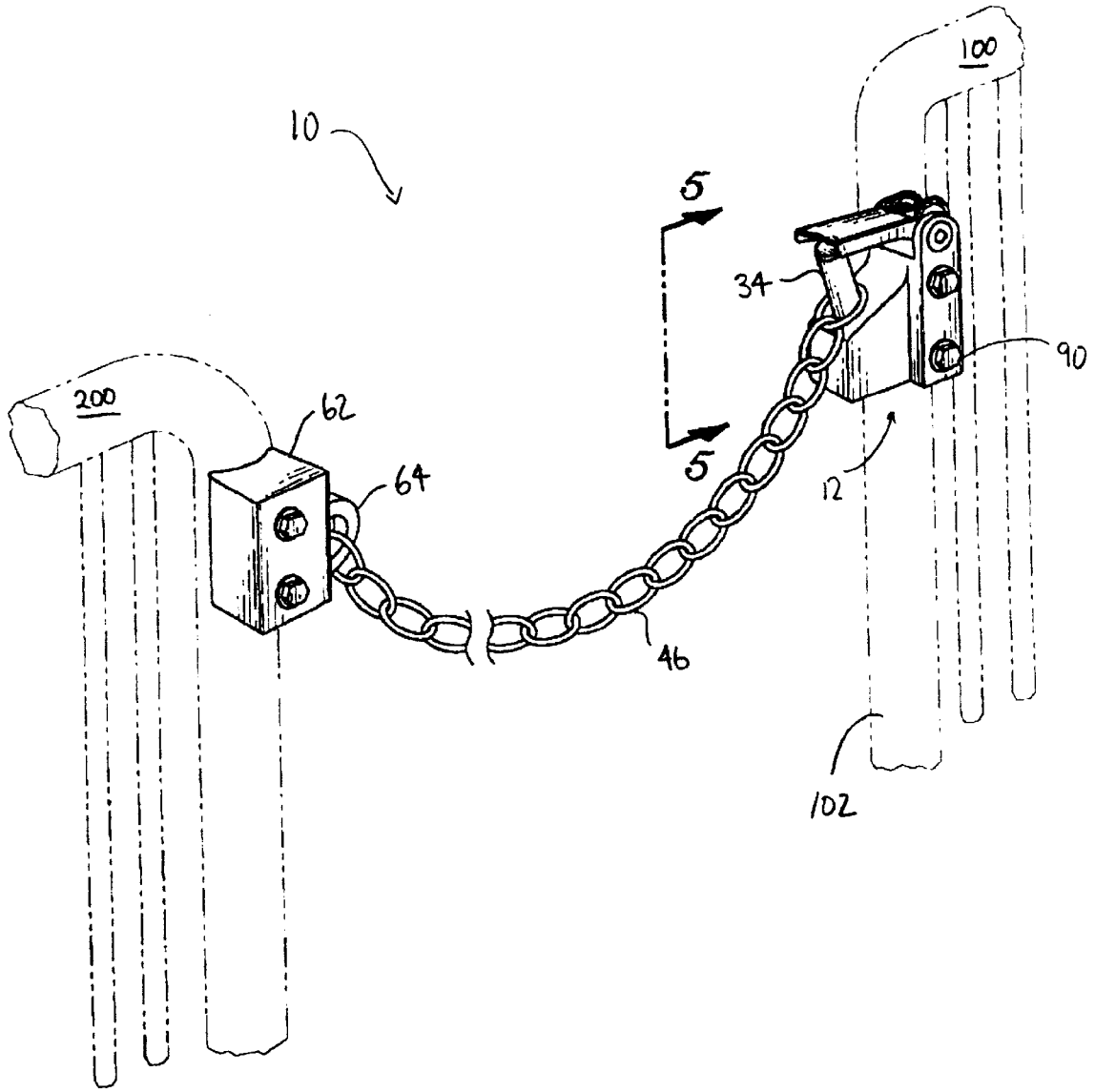
FIG. 1 is a perspective view of a queue clip mounted to a control gate according to a first preferred embodiment, including a holder having a coupler mounted to another control gate.

Turning now in detail to the drawings, as shown in FIG. 1, a queue clip 10 according to a first preferred embodiment is mounted to one side of a control gate 100. The queue clip 10 supports one end of a chain 46. The other end of the chain 46 may be supported by a coupler mounted to a holder, such as the coupler 64 and holder 62 illustrated in FIG. 1. The holder 62 is mounted to a second control gate 200 spaced apart from the first control gate 100. The control gates 100, 200 shown in FIG. 1 are often used to separate members of a crowd from the participants of an event, such as a parade, and may be used to help organize guests of an amusement park into one or more queues prior to purchasing a ticket, or riding on an amusement ride, etc. Although the queue clip 10 may be used as a latch or the like for other types of gates, the queue clip 10 is particularly adapted for use with control gates 100, 200. Accordingly, the queue clip 10, in conjunction with a chain 46 or the like, is preferably used to link one crowd control gate 100 to another 200.

Figure 2:
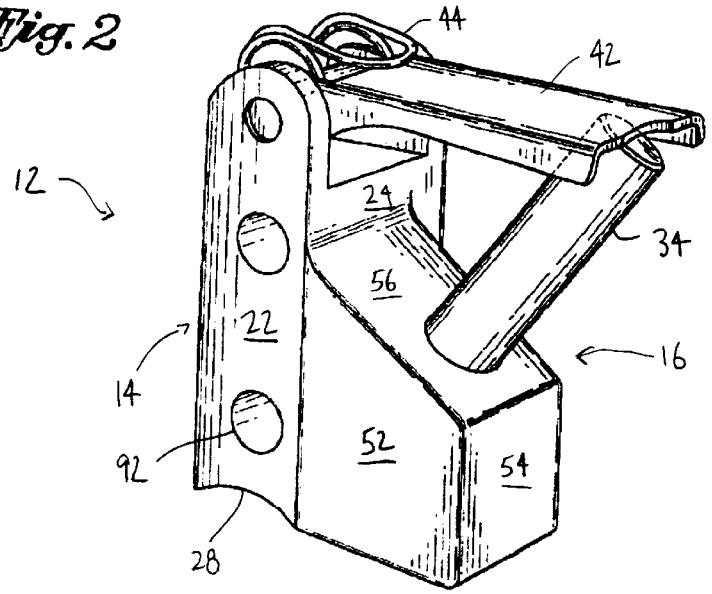
FIG. 2 is a perspective, detailed view of the queue clip shown in FIG. 1.
Figure 3:
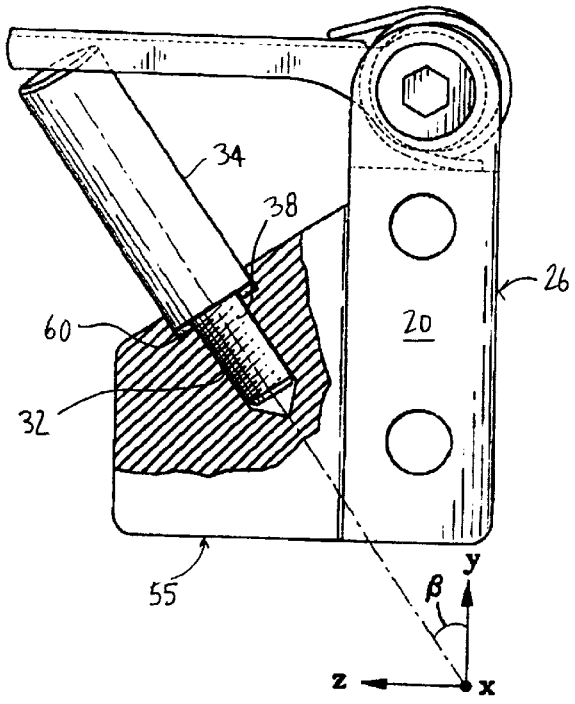
FIG. 3 is a front, partially cut-away view of the queue clip shown in FIG. 1.
Figure 4:
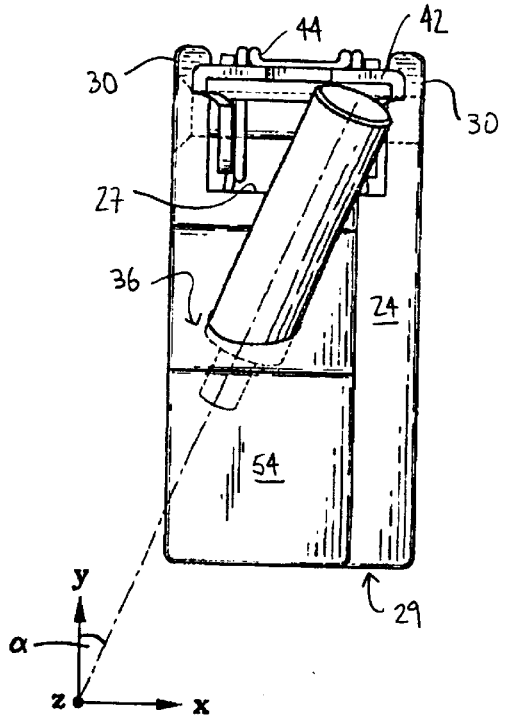
FIG. 4 is a left side view of the queue clip shown in FIG. 1.
Figures 5, 6, 7:
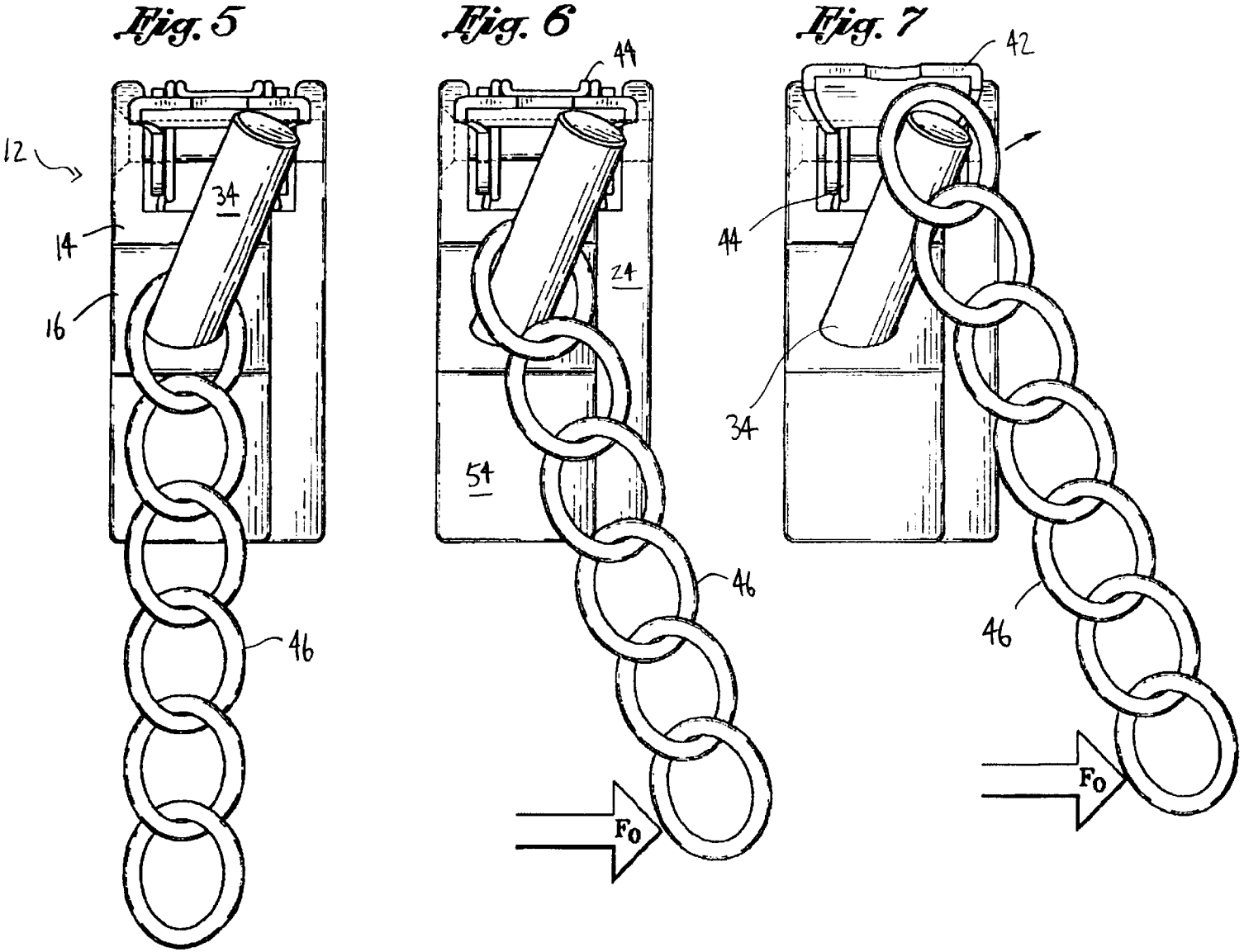
FIG. 5 is a left side view of the queue clip shown in FIG. 1 illustrating the chain supported by the rod in an at-rest position.
FIG. 6 illustrates the chain sliding up the rod due to an outward force acting against the chain from its at-rest position as shown in FIG. 5.
FIG. 7 illustrates the chain sliding up and off the rod due to a continuous outward force acting against the chain from its transitory position as shown in FIG. 6.
Figure 9:
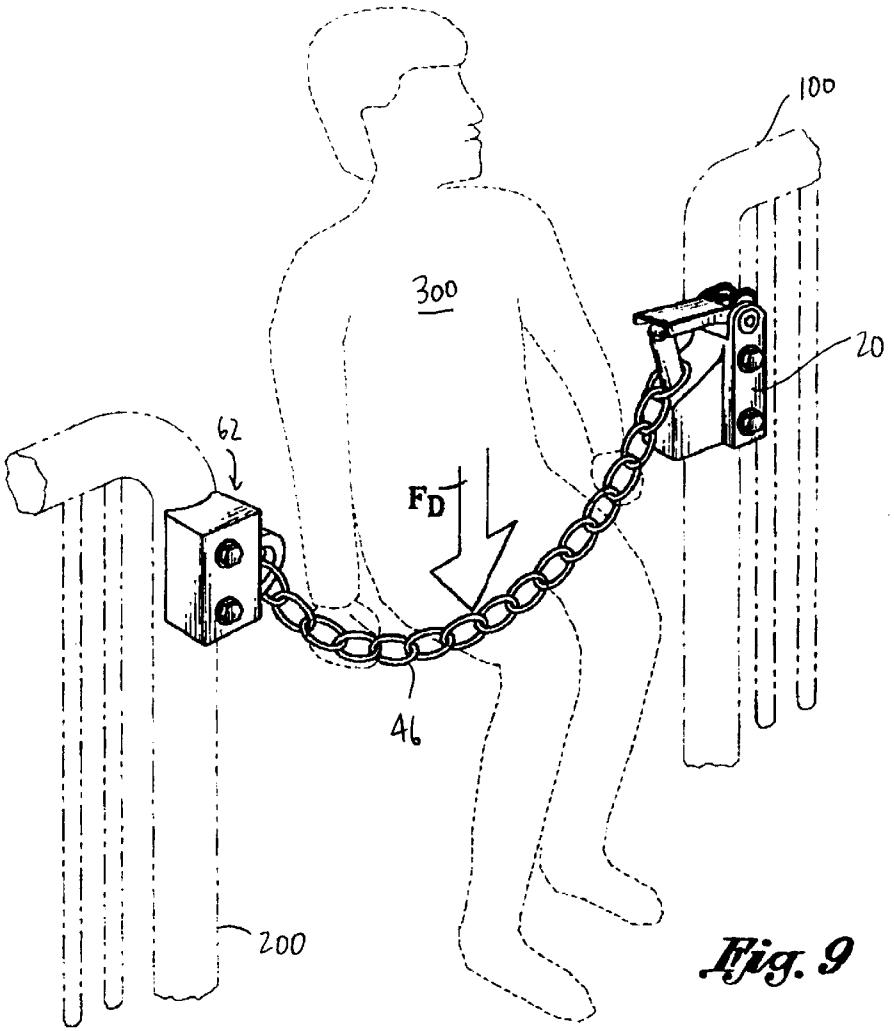
FIG. 9 is a perspective view of the queue clip shown in FIG. 1 illustrating the chain supports even a large downward force.

Referring to FIGS. 2–4, the queue clip 10 shown in FIG. 1 includes a holder 12 and a rod 34 angled to the holder 12. The holder 12 includes a front wall 20, a rear wall 22, a left side wall 24, a right side wall 26, a top wall 27, and a bottom wall 29. The rear wall 22 of the holder 12 is preferably includes a concavity 28 for form-fitting to a post 102 of the control gate 100. The rod 34 is angled to the holder 12 for supporting the chain 46 when a force is applied to the chain 46 in a downward direction and/or an inward direction, and for releasing the chain 46 when a force to is applied to the chain 46 in an outward direction. A "downward" force and/or direction is illustrated by the $F_D$ arrow in FIG. 9. As shown in FIG. 9, the downward force $F_D$ may be due to the weight of a guest 300 sitting on the chain. As used herein, "outward" refers to a direction away from the queue or crowd. An outward force and/or direction is illustrated in FIGS. 6–7 by the $F_O$ arrow. An "inward" direction and/or force is illustrated by the $F_I$ arrow in FIG. 10, which is used to refer to a direction toward the queue or crowd.

Turning in detail to FIGS. 2–4, the holder body 14 preferably includes a nose member 16 protruding from one of the side walls 24, 26 of the holder 12. As shown in the drawings, the nose 16 is extending or protruding from the left side wall 24 of the holder body 14. The nose 16 includes an anterior wall 50, a posterior wall 52, a top wall 56, a bottom wall 55, and two opposing side walls 55 (only one of which is shown). The top wall 56 of the nose 16 may be sloped or inclined downward. Such a configuration is preferred to allow the rod or tongue 34 to be cantilevered off the side wall 24 of the holder 12, and more particularly the top wall 56 of the nose 16 while maintaining the desired angular relationship of the rod 34 to the holder body 14.

As shown in FIG. 3, the tongue 34 is cantilevered off of the top wall 56 of the nose 16 such that it extends upwardly toward the top wall 27 of the body 14. FIG. 3 also illustrates the tongue 34 is angled to the holder body 14 at an angle $\beta$ from a y-axis in a y-z plane. The angle $\beta$ is preferably in the range of about 35° to about 55° from the y-axis, and most preferably about 45°.

As shown in FIG. 4, the tongue 34 is also cantilevered off of the top wall 56 of the nose 16 such that it extends outwardly toward the front wall 20 of the body 14. The tongue 34 is angled to the holder body 14 at an angle $\alpha$ from a y-axis in a x-y plane. The angle $\alpha$ is preferably in the range of about 35° to about 55° from the y-axis, and most preferably less than 45°.

Although it is preferred to have the tongue 34 integral to the holder 12, FIGS. 3 and 4 also illustrate that the tongue 34 may be a separate piece. Should the tongue 34 not be integral to the holder 12, the nose 16 may include a threaded slot 32 for receiving a tongue 34 having a correspondingly threaded projection 38 at is bottom end 36. The slot 32 may be recessed into the surface of the top wall 56 of the nose 16 to define a shoulder 60 (shown best in FIG. 10) against which the bottom portion of the tongue 34 is snugly adapted to fit against. Such an arrangement is preferred to allow the rod 34 to counteract torsional forces applied against the chain 46.

The queue clip 10 may include a spring-loaded retaining lever 42 mounted to two opposing arms or extensions 30 near the top wall 27 of the holder body 14. Each arm 30 extends upwardly from a respective side wall 24, 26 to provide clearance for the lever 42 to rotate about the top wall 27. The bias of the spring 44 allows the lever 42 to counteract nominal or small forces applied against the chain 46. In this manner, the chain 46 will be supported by the rod 34 until a sufficient force makes contact with the chain 46 that is greater than the load applied by the spring 44. Such a force, for example, may be due to someone walking briskly into, or pushing horizontally on, the chain 46.

To install the queue clip 10, the user drills two holes through the side of the gate 100 and the queue clip 10 is secured with fasteners, such as fasteners 90 illustrated in FIG. 1 which preferably include grade 8 bolts and nylon retaining nuts. Each bolt of the fasteners 90 is inserted through a mounting bore 92 that passes through the holder body 14 from the front wall 20 to the rear wall 22. The second holder 62 that includes the coupler 64 is mounted to the same side of the other control gate 200 which is spaced apart from the first control gate 100, in a similar manner as the holder 12 of the queue clip 10.

In use, the control gates 100, 200 are positioned at pre-designated locations. The spring-loaded retaining lever 42 (if there is one), if lifted up and the end link of a chain (which is preferably a standard hardened steel chain 46), is placed onto the rod or tongue 34 of the queue clip 10. The other end of the chain 46 is attached to the coupler 64 of the second holder 62. Assuming the coupler 64 is not a closed loop, the end link may be slipped about the open end of the coupler 64, as shown in FIG. 1. Alternatively, should the coupler 64 be a solid loop, the other end of the chain 46 may be attached to the coupler 64 via any means, such as a key-ring style clip or the like.

FIGS. 5–7 illustrate how the chain 46 slides up and off the rod 34 due to an outward force $F_O$ being applied against the chain 46. FIG. 5 shows the chain 46 being supported by the rod 34 in an at-rest position. In this manner, the chain 46 hangs freely such that it rests in the juncture formed by the rod 34 and the top wall 27 of the nose 16. FIG. 6 illustrates the chain 46 sliding up the rod 34 due to an outward force $F_O$ acting against the chain 46 from its at-rest position as shown in FIG. 5. FIG. 7 illustrates the chain 46 sliding up and off the rod 34 due to a continuous outward force $F_O$ acting against the chain 46 from its transitory position as shown in FIG. 6. As shown in FIG. 7, sufficient outward force $F_O$ has been applied against the chain 46 to counteract the bias of the spring 44 of the lever 42 such that the chain 46 is able to travel up and over the tip of the rod 34. After the chain 46 is slid off the tongue 34 and/or released by the queue clip 10, the guest 300, who was previously confined by the chain 46, can now freely pass between the control gates 100, 200.

Figure 8:
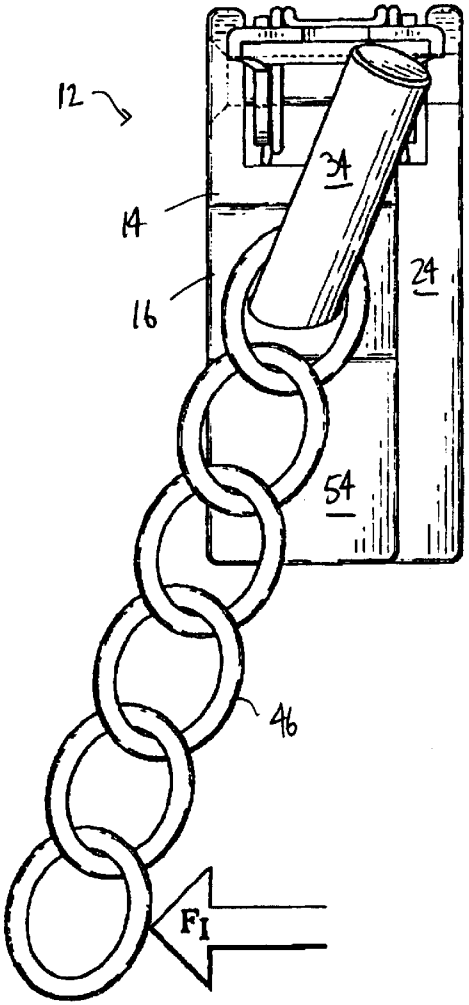
FIG. 8 is a left side view of the queue clip shown in FIG. 1 illustrating that the chain does not slide up the rod when an inward force acts against the chain.

FIG. 8 illustrates how the chain 46 does not slide up the rod 34 when an inward force $F_I$ acts against the chain 46. As shown in FIGS. 1–9, the rod 34 is angled to the holder 12 such that the rod or tongue 34 extends outwardly from the top wall 56 of the nose 16 toward the front wall 20 of the body 14. Due to such an orientation, the chain 46 is not permitted to slide up the rod 34 by a person applying an inward force $F_I$ against the chain 46. Such an inward force $F_I$ may be created, for example, by a guest 300 who wants to ride an amusement ride but does not want to wait his turn, i.e., someone who is outside of a queue and is trying to cut into the queue. Thus, the queue clip 10 shown in FIGS. 1–9 allows for only one direction of travel. An impatient guest 300, therefore, cannot force inward entry between crowd control gates 100, 200.

FIG. 9 illustrates how the rod 34 is able to support a downward force $F_D$, or a force in the vertical plane, applied against the chain 46. In particular, FIG. 9 shows a person or guest 300 sitting on the chain 46. Due to the orientation of the rod angle to the holder 12 in the y-z plane and the strength of chain 46, the weight of the guest 300 will be supported by the queue clip 10. Thus, the queue clip 10 advantageously allows for high loads in the vertical plane, e.g., the weight of a sitting person, while being versatile enough to break-away or open up, when necessary.

Figure 10:
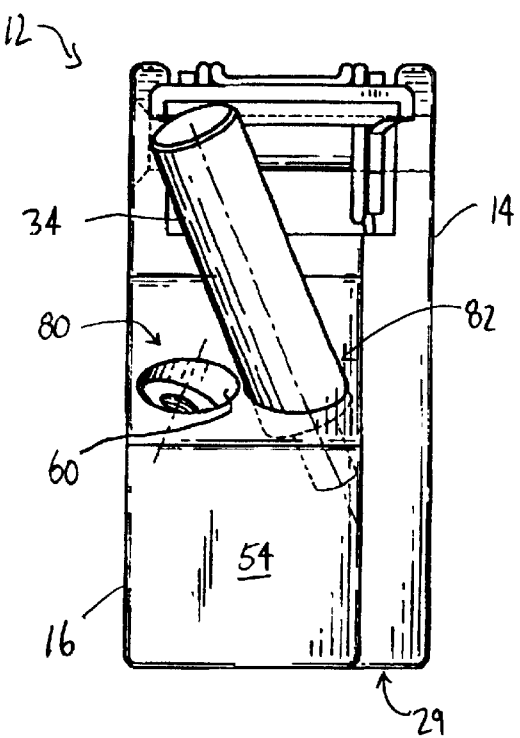
FIG. 10 is a left side view of a queue clip according to a second preferred embodiment.

Turning in detail to FIG. 10, a second preferred embodiment illustrates the holder 12 as having a pair of bores 80, 82 for respectively receiving the tongue or rod 34 of the queue clip 10. The bores 80, 82 are preferably threaded. One bore 80 is configured to open toward the front wall 20 of the holder 12, whereas the second bore 82 is configured to open toward the rear wall 22 of the holder 12. Advantageously, this embodiment allows the tongue 34 to be retained in either bore 80, 82. In this manner, the user can set the control gates 100, 200 at pre-designated locations regardless as to whether the side of the control gate 100 having the queue clip 10 mounted thereto is facing inward to where the queue will be or outward to where the queue will be. Accordingly, the user of this embodiment need not remount the queue clip 10 if the direction of release of the chain 34 is not as desired, rather, the user need only screw the tongue 34 into the other bore 80 or 82.

Figure 12:
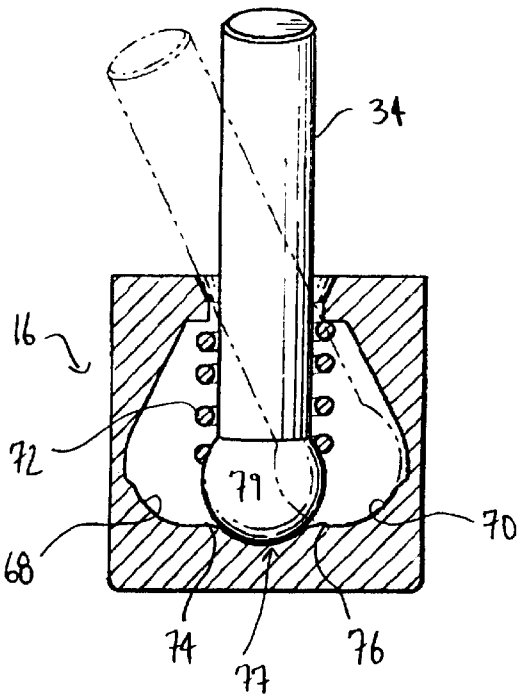
FIG. 12 is a cross-sectional view of the queue clip shown in FIG. 11 taken along line 12—12.
Figure 11:
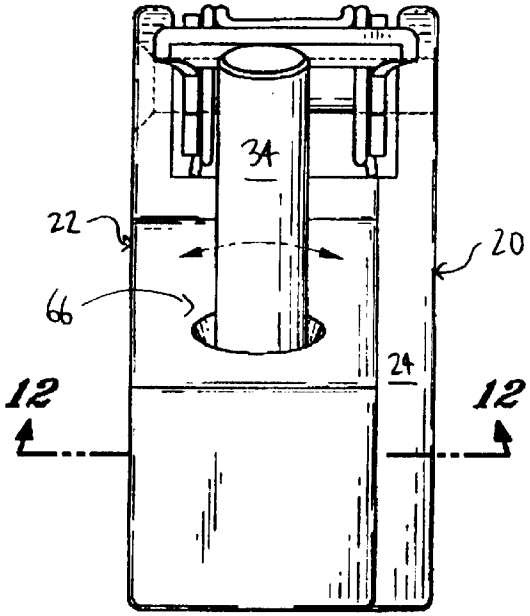
FIG. 11 is a left side view of a queue clip according to a third preferred embodiment.

Turning in detail to FIGS. 11 and 12, a third preferred embodiment illustrates the holder 12 may include a channel 66 adapted to receive the tongue 34 such that the tongue 34 is translatable within the channel 66. The channel 66 may include a pair of socket members or chambers 68, 70 separated by a recessed seating area 77 formed by a pair of detents 74, 76 projecting into the channel 66. The tongue 34 preferably includes a ball member 79 configured to fit within each of the chambers 68, 70. In at at-rest position, as shown in FIG. 12 by the solid lines, the ball 79 is seated within the seating area 77 wherein the rod 34 is angled only with respect to the y-z plane (as shown for example in FIG. 3). However, a guest in line 300 may apply sufficient pressure against the chain 46 to cause the ball member 79 to lodge into one of the two chambers 68, 70 (as shown for example in FIG. 12 by the dashed lines) to quickly release the chain 46 from the tongue 34. To prevent nominal or small forces from forcing the ball 79 over one of the detents 74, 76 and into a respective chamber 68, 70, a compression spring 72 may be disposed about the bottom portion of the rod 34 that is contained within the channel 66. Advantageously, this embodiment allows quick release of the chain 46 from the tongue support 34 regardless of the guest's direction of movement.

Thus, a novel queue clip has been shown and described. Various modifications may of course be made, and various substitutions of equivalents may be used, without departing from the spirit and scope of the invention. The invention, therefore, should not be restricted, except to the following claims are their equivalents.

What is claimed is:

1. A queue clip comprising:

a holder having a longitudinal axis;

a substantially cylindrical rod extending from the holder at an acute angle with respect to a first direction substantially perpendicular to the longitudinal axis defined by the holder, wherein the rod also extends from the holder at an acute angle with respect to a second direction substantially perpendicular to the first direction, wherein the holder includes a threaded bore for receiving the rod such that the rod is integral to the holder.

2. A queue clip according to claim 1 further comprising a retaining lever mounted to the holder.

3. A queue clip according to claim 1 wherein the holder includes a concave rear wall.

4. A queue clip according to claim 1 wherein the holder includes a nose member having the threaded bore for receiving the rod.

5. A queue clip according to claim 4 wherein the threaded bore is recessed in the surface of the nose member.

6. A queue clip according to claim 1 wherein the holder includes a nose member and wherein the threaded bore includes a first threaded bore and a second threaded bore, each bore being adapted to receive the rod.

7. A queue clip according to claim 6 wherein the first threaded bore is recessed in the surface of the nose member and the second threaded bore is recessed in the surface of the nose member.

8. A queue clip according to claim 1 wherein the rod extends from the holder at an angle $\alpha$ from the axis defined by the holder in an x-y plane, wherein $\alpha$ is about 35° to about 55°.

9. A queue clip according to claim 1 wherein the rod extends from the holder at an angle $\beta$ from the axis defined by the holder in a y-z plane, wherein $\beta$ is about 35° to about 55°.

10. A queue clip for control gates comprising:

a holder body, the body including a front wall, a rear wall opposite the front wall, a first side wall substantially perpendicular to the front wall, a second side wall opposite the first side wall, a top wall substantially perpendicular to the front wall, and a bottom wall opposite the top wall; and a cantilevered tongue being cantilevered off of the first side wall wherein the tongue extends upwardly toward the top wall, and wherein the tongue extends outwardly toward one of the front wall and the rear wall, wherein the holder body includes a nose member protruding from the first side wall of the holder body, the nose member including a threaded bore for receiving the tongue.

11. A queue clip according to claim 10 wherein the threaded bore is recessed in the surface of the nose member.

12. A queue clip according to claim 10 wherein the holder body includes a nose member protruding from the first side wall, the nose member including a first threaded bore adapted to receive the tongue such that when the tongue is received therein the tongue extends outwardly toward the front wall, and wherein the nose member includes a second threaded bore adapted to receive the tongue such that when the tongue is received therein the tongue extends outwardly toward the rear wall.

13. A queue clip according to claim 12 wherein the first threaded bore is recessed in the surface of the nose member and the second threaded bore is recessed in the surface of the nose member.

14. A queue clip according to claim 10 wherein the holder body includes a nose member protruding from the first side wall of the holder body, the nose member including a channel adapted to receive the tongue such that the tongue may be automatically oriented to extend outwardly toward one of the front wall and the rear wall.

15. A queue clip according to claim 14 wherein the tongue includes a ball at one end thereof, and wherein the channel includes first and second socket members each of the socket members being adapted to receive the ball.

16. A queue clip according to claim 15 wherein the channel includes a pair of detents separating the first socket member from the second socket member.

17. A queue clip according to claim 16 further comprising a spring disposed about the tongue for biasing the tongue within the channel between the pair of detents.

18. A queue clip according to claim 10 further comprising a retaining lever spring mounted to the first and second side walls of the holder body.

19. A queue clip according to claim 10 further comprising a second holder body spaced apart from the holder body.

20. A queue clip according to claim 10 wherein the tongue extends upwardly from the holder body at an angle $\alpha$, wherein $\alpha$ is about 35° to about 55°.

21. A queue clip according to claim 10 wherein the tongue extends outwardly from the holder body at an angle $\beta$, wherein $\beta$ is about 35° to about 55°.

22. A quick release latch comprising:

a body having a front wall, a rear wall, a first side wall, and a second side wall, the body adapted for mounting to a first crowd control gate;

a nose protruding from the first side wall, the nose including a top wall;

a substantially cylindrical tongue extending from the top wall of the nose in an upward direction and wherein the tongue also extends in an outward direction that is substantially perpendicular to the upward direction; and a retaining lever spring mounted to the body.

23. A latch according to claim 22 wherein the top wall of the nose is inclined.

24. A latch according to claim 22 wherein the nose includes a threaded bore for receiving the tongue.

25. A latch according to claim 22 wherein the nose includes a first threaded bore and a second threaded bore, each bore being adapted to receive the rod.

26. A latch according to claim 22 wherein the nose includes a channel adapted to receive the tongue such that the tongue is pivotable within the channel.

27. A latch according to claim 26 further comprising a spring disposed about the tongue for biasing the tongue within the channel.

28. A queue clip for control gates comprising:

a holder body for mounting to a control gate, the body including a front wall, a rear wall, a first side wall, a second side wall, a top wall, and a bottom wall, the holder body further including a nose member protruding from the first side wall of the holder body, the nose member including a channel adapted to receive the tongue; and a cantilevered tongue for supporting a chain, the tongue being cantilevered off of the first side wall wherein the tongue extends upwardly toward the top wall and outwardly toward one of the front wall and the rear wall, wherein the tongue includes a ball at one end thereof, and wherein the channel includes first and second socket members each of the socket members being adapted to receive the ball.

29. A queue clip comprising:

a holder having an axis;

a substantially cylindrical rod extending from the holder at an acute angle with respect to a first direction substantially perpendicular to the axis defined by the holder, wherein the rod also extends from the holder at an acute angle with respect to a second direction substantially perpendicular to the first direction, wherein the holder includes a nose member having a first threaded bore and a second threaded bore, each bore being adapted to receive the rod.

30. A queue clip comprising:

a holder having a longitudinal axis;

a substantially straight rod extending from the holder at an acute angle with respect to a first direction substantially perpendicular to the longitudinal axis defined by the holder, wherein the rod also extends from the holder at an acute angle with respect to a second direction substantially perpendicular to the first direction, wherein the holder includes a channel adapted to receive the rod such that the rod is pivotable within channel.

* * * * *